US009980555B1

(12) United States Patent
Vosbikian et al.

(10) Patent No.: US 9,980,555 B1
(45) Date of Patent: May 29, 2018

(54) CONVERTIBLE PUSH BROOM

(71) Applicants: Peter S Vosbikian, Moorestown, NJ (US); Robert Petner, Burlington, NJ (US)

(72) Inventors: Peter S Vosbikian, Moorestown, NJ (US); Robert Petner, Burlington, NJ (US)

(73) Assignee: Zenith Innovation, LLC, Moorestown, NJ (US)

( * ) Notice: Subject to any disclaimer, the term of this patent is extended or adjusted under 35 U.S.C. 154(b) by 0 days. days.

(21) Appl. No.: 15/717,163

(22) Filed: Sep. 27, 2017

Related U.S. Application Data

(63) Continuation-in-part of application No. 15/672,913, filed on Aug. 9, 2017.

(51) Int. Cl.

| | |
|---|---|
| ***A46B 5/00*** | (2006.01) |
| ***A46B 15/00*** | (2006.01) |
| ***B25G 3/26*** | (2006.01) |
| *A46B 7/04* | (2006.01) |

(52) U.S. Cl.
CPC ..... *A46B 5/0095* (2013.01); *A46B 15/0095* (2013.01); *B25G 3/26* (2013.01); *A46B 7/04* (2013.01); *A46B 2200/302* (2013.01); *Y10T 16/469* (2015.01)

(58) Field of Classification Search
CPC ..... A46B 5/00; A46B 5/0095; A46B 7/00; A46B 7/02; A46B 7/04; A46B 7/042; A46B 7/044; A46B 7/046; A46B 7/048; A46B 15/00; A46B 15/0095; A46B 17/00; A46B 17/02; A46B 2200/302; B25G 1/00; B25G 1/06; B25G 3/00; B25G 3/02; B25G 3/12; B25G 3/16; B25G 3/20; B25G 3/24; B25G 3/26; B25G 3/30; B25G 3/32; Y10T 16/469; Y10S 16/24; Y10S 16/25; Y10S 16/41
USPC ..... 15/144.1, 145, 146, 159.1, 172, 15/176.1–176.3, 176.6; 16/422, DIG. 24, 16/DIG. 25, DIG. 41; 206/361, 362.2
See application file for complete search history.

(56) References Cited

U.S. PATENT DOCUMENTS

| | | | | | |
|---|---|---|---|---|---|
| 4,550,829 | A * | 11/1985 | Strahs | A47L 13/46 | 15/145 |
| 5,502,862 | A * | 4/1996 | Vosbikian | A46B 5/0095 | 15/145 |
| 2004/0265053 | A1* | 12/2004 | Weaver | A46B 17/02 | 403/389 |
| 2013/0031736 | A1* | 2/2013 | Martin | A46B 7/04 | 15/105 |

* cited by examiner

*Primary Examiner* — Mark Spisich
(74) *Attorney, Agent, or Firm* — Stuart M. Goldstein

(57) ABSTRACT

A push broom has a straight push broom handle with a longitudinal axis and a push broom block having a longitudinal axis. The push broom block has outwardly extending dual brackets and an upstanding handle connecting member for accepting and securing the handle. The handle is configured to be secured such that its longitudinal axis is parallel to the longitudinal axis of the push broom block in the shipping and merchandising mode. The handle is configured to be secured within the handle connecting member such that its longitudinal axis is perpendicular to the longitudinal axis of the push broom block in the push broom's use mode. An integrally molded, "U" shaped strap is also provided to support and brace the handle in its various modes.

16 Claims, 9 Drawing Sheets

CONVERTIBLE PUSH BROOM

RELATED APPLICATION

This application is a continuation-in-part of application Ser. No. 15/672,913, filed on Aug. 9, 2017, and now abandoned.

FIELD OF THE INVENTION

This invention relates to long handled cleaning tools, especially push brooms, and the manner they are transported, merchandised, displayed, and used.

BACKGROUND OF THE INVENTION

Push brooms are effective and efficient tools for sweeping and cleaning horizontal surfaces. The common push broom comprises an elongated handle having threads at its end and a push broom block which has a plurality of cleaning bristles attached to its underside. The push broom block usually has a threaded bore through its top surface. The bore is configured to threadably engage the handle's threaded end, such that the handle is attached perpendicularly to the broom block in the broom's cleaning use mode.

Significantly, push broom manufacturers do not transport their product to wholesalers and ultimately to retail sellers in this use mode configuration. Shipping multiple push brooms while in this configuration is awkward and, as a practical matter, difficult to stow and transport. Thus, in order to save valuable shipping container space, push brooms are secured with their blocks attached to their handles, such that the longitudinal axii of the blocks and handles are parallel to each other. This shipping arrangement not only provides an effective and cost efficient method of transporting push brooms, but also has space saving advantages in the retail merchandising and display of the push brooms at the retail level.

However, problems arise in the manner of push broom blocks to push broom handles are actually connected in the shipping/merchandising mode. Blocks routinely separate from their handles, often resulting in lost and damaged broom components. At the product display level, separated push broom blocks and handles can also be damaged and, at the very least, detract visually from the merchandising display.

In order to address these problems, various push broom block to handle connections have been utilized. String, twist ties, rubber bands, and similar simple connectors have been and are used, albeit with very limited success. More substantial fasteners, like clips, have also been suggested. For instance, U.S. Pat. No. 4,550,829 describes a spring clip system and U.S. Pat. No. 7,131,170 discloses the use of separate threaded broom locking clips. However, such clip utilized systems have distinct disadvantages. Most importantly, they do not provide absolute detachable connections. These clips still have a tendency to come loose, causing the handle and broom to separate. In addition, these systems require several different, independent components, which results in added costs of manufacture and shipping.

There is thus no current push broom head and handle attachment system which not only successfully addresses the shipping and merchandising issue in economical fashion, but also provides for ready detachment from a tight and secure attachment of the block to the handle in the shipping mode, to a tight and secure attachment of the block to the handle for actual use of the push broom.

SUMMARY OF THE INVENTION

It is thus the object of the present invention to overcome the limitations and disadvantages of the shipping, display, and use of push brooms and other hand cleaning push tools.

It is a general object of the present invention to provide an efficient, effective, and economical means of securing the handle of a push broom to its broom head during the transport and merchandising of the push broom and then during the use of the push broom as a cleaning tool.

It is another Object of the present invention to provide a push broom with a push broom head which will effectively and efficiently be secured to a push broom handle, without risk of separation during transport and merchandising of the push broom and during its use as a cleaning tool.

It is a further object of the present invention to provide a push broom which can readily be converted from a shipping mode to a use mode.

It is still a further object of the invention to provide an efficient, effective, and economic means of securing the push broom handle to the push broom head in order to save valuable cargo and container space, to ensure distribution and sale efficiency, to prevent loss of broom components during transport and merchandising, and to save resources needed to produce and dispose of non-reusable handle to head connectors.

These and other objects are accomplished by the present invention, a push broom having a straight push broom handle with a longitudinal axis and a push broom block having a longitudinal axis. The push broom block has outwardly extending dual brackets and an upstanding handle connecting member for accepting and securing the handle. The handle is configured to be secured such that its longitudinal axis is parallel to the longitudinal axis of the push broom block in the shipping and merchandising mode. The handle is configured to be secured within the handle connecting member such that its longitudinal axis is perpendicular to the longitudinal axis of the push broom block in the push broom's use mode.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

DETAILED DESCRIPTION OF THE INVENTION

Figure 1:
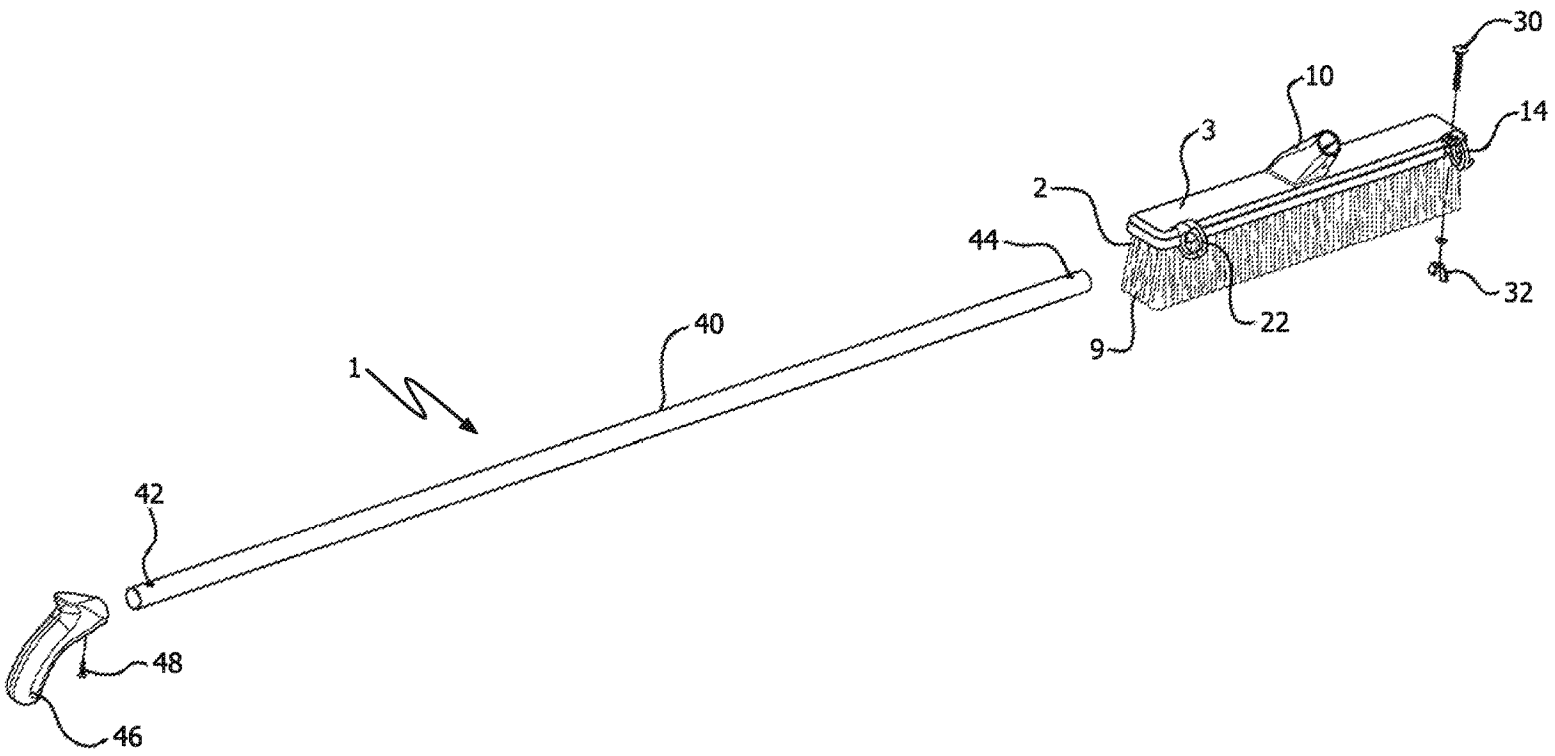
FIG. 1 is an exploded view of the components of the push broom of the present invention.

Push broom 1 of the present invention comprises push broom head 2 having push broom block 3, and handle 40. Push broom block 3 has longitudinal axis 4 extending the length of the block, top surface 5, front surface 6, and rear surface 7. Block 3 also comprises handle receiving member 10 extending upwards from top surface 5. Handle receiving member 10 has opening 12 for receiving and maintaining push broom handle 40. Cleaning bristles 9 extend down from block 3.

First bracket means in the form of bracket 14, is an integral component part of push broom block 3. Bracket 14 extends outwardly and rearwardly from rear surface 7 of one end of push broom block 3. Bracket 14 has opening 16 configured to receive and maintain one end of push broom handle 40. Bracket 14 also comprises tab 18 with through channel 20 configured to accept bolt 30.

Second bracket means in the form of bracket 22 is also integral component part of push broom block 3. It is located at the opposite end of push broom block 3 and also extends outwardly and rearwardly from rear surface 7 of the push broom block. Bracket 22 has opening 24 configured to receive and maintain an upper portion of broom handle 40.

Figure 5:
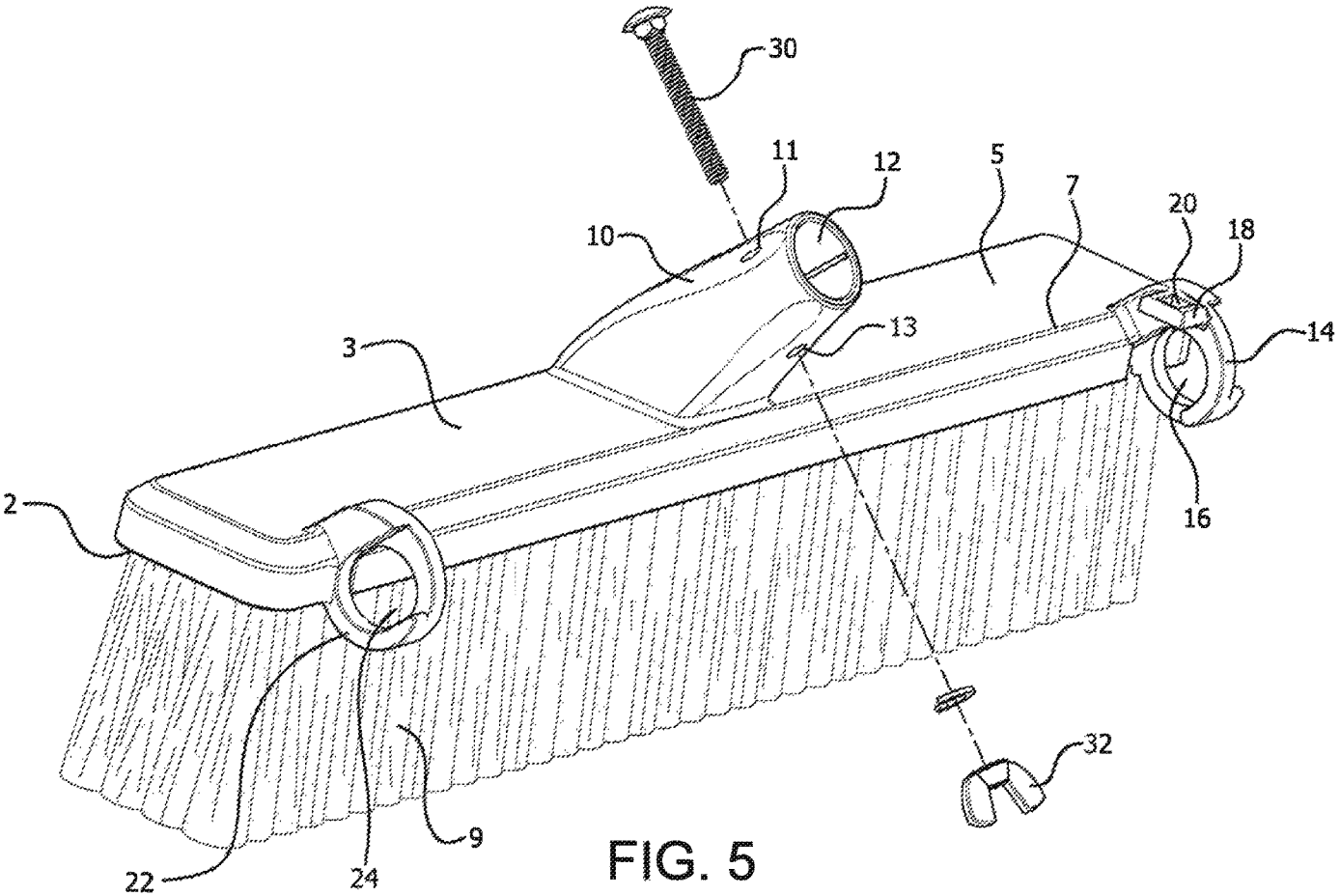
FIG. 5 is a close-up view of the push broom head of the present invention.
Figure 6:
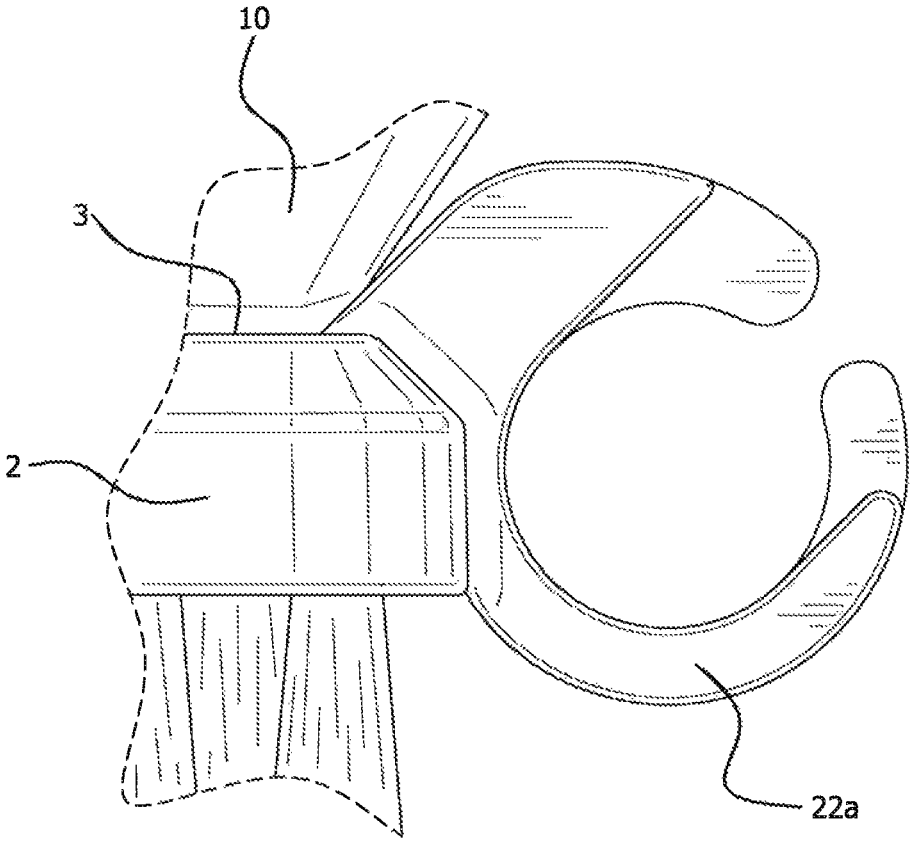
FIG. 6 is an elevation view of an alternate bracket embodiment of the push broom head of the present invention.
Figure 7:
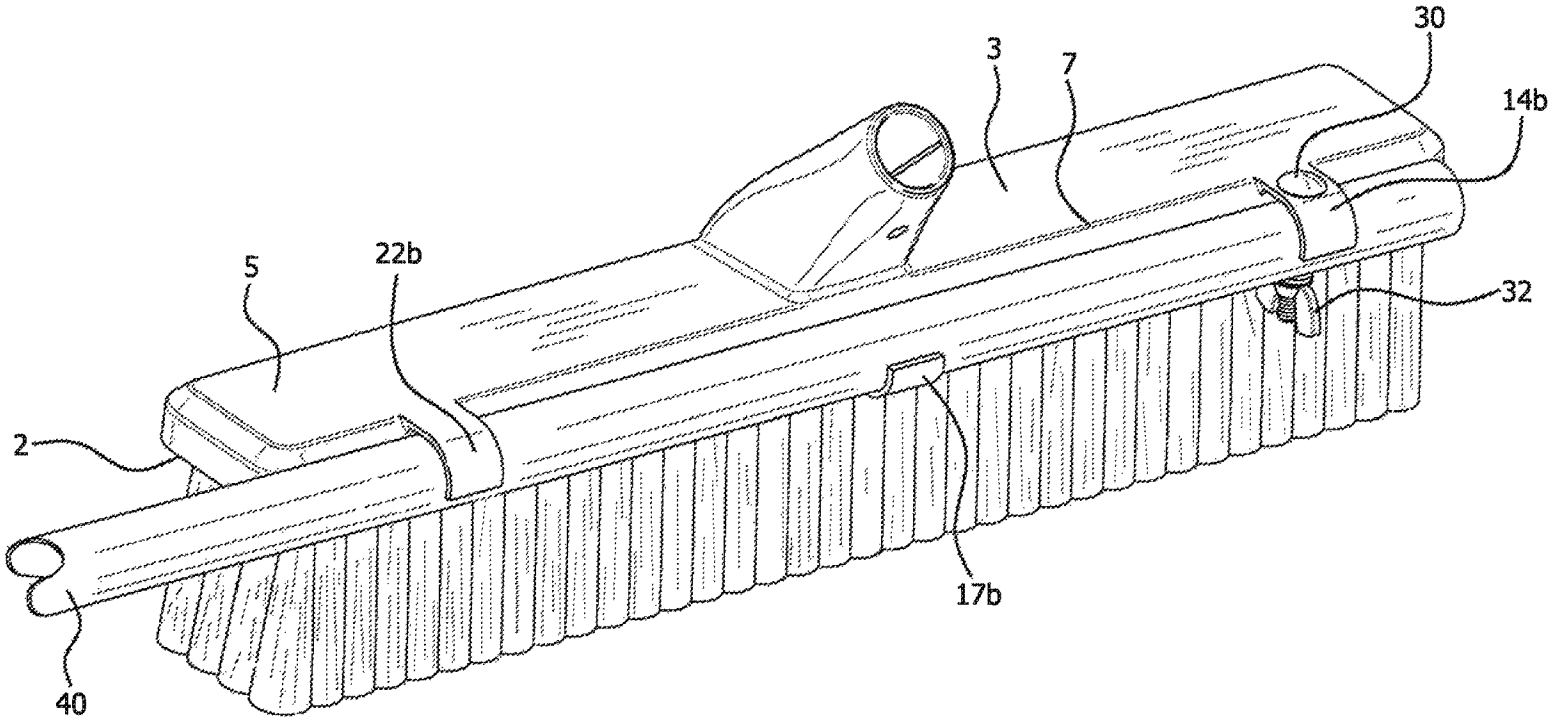
FIG. 7 is a perspective view of still another embodiment of the push broom of the present invention in the shipping and merchandising mode.

Brackets 14 and 22, shown in detail in FIG. 5, are closed loops, designed to fully surround handle 40 when the handle is in the shipping and merchandise mode, as described below. Alternatively, the brackets can be slightly open loops, as shown in FIG. 6. Alternate second bracket means, bracket 22*a*, is designed to accept, but not fully surround, handle 40. FIG. 7 shows still another embodiment of the invention, wherein curved, partial first and second bracket means, i.e. 14*b* and 22*b*, along with intermediate bracket 17*b*, cradle and support handle 40. Bolt 30 and wing nut 32 secure handle 40 to push broom block 3, in the same manner as has been previously described.

Whether enclosed brackets 14 and 22, open bracket 22*a*, or partial brackets 14*b*, 17*b*, and 22*b* are utilized, the brackets are made of a rigid, non-flexible material. As a result, removal of handle 40 from the brackets can only be accomplished by sliding the handle out of the brackets.

Handle 40 has longitudinal axis 41, extending the length of the handle, opening 42 through one surface of the handle and opening 44 through the diametrically opposite surface of the handle. Handgrip 46 is secured to handle 40 by means of screw 48.

Figure 2:
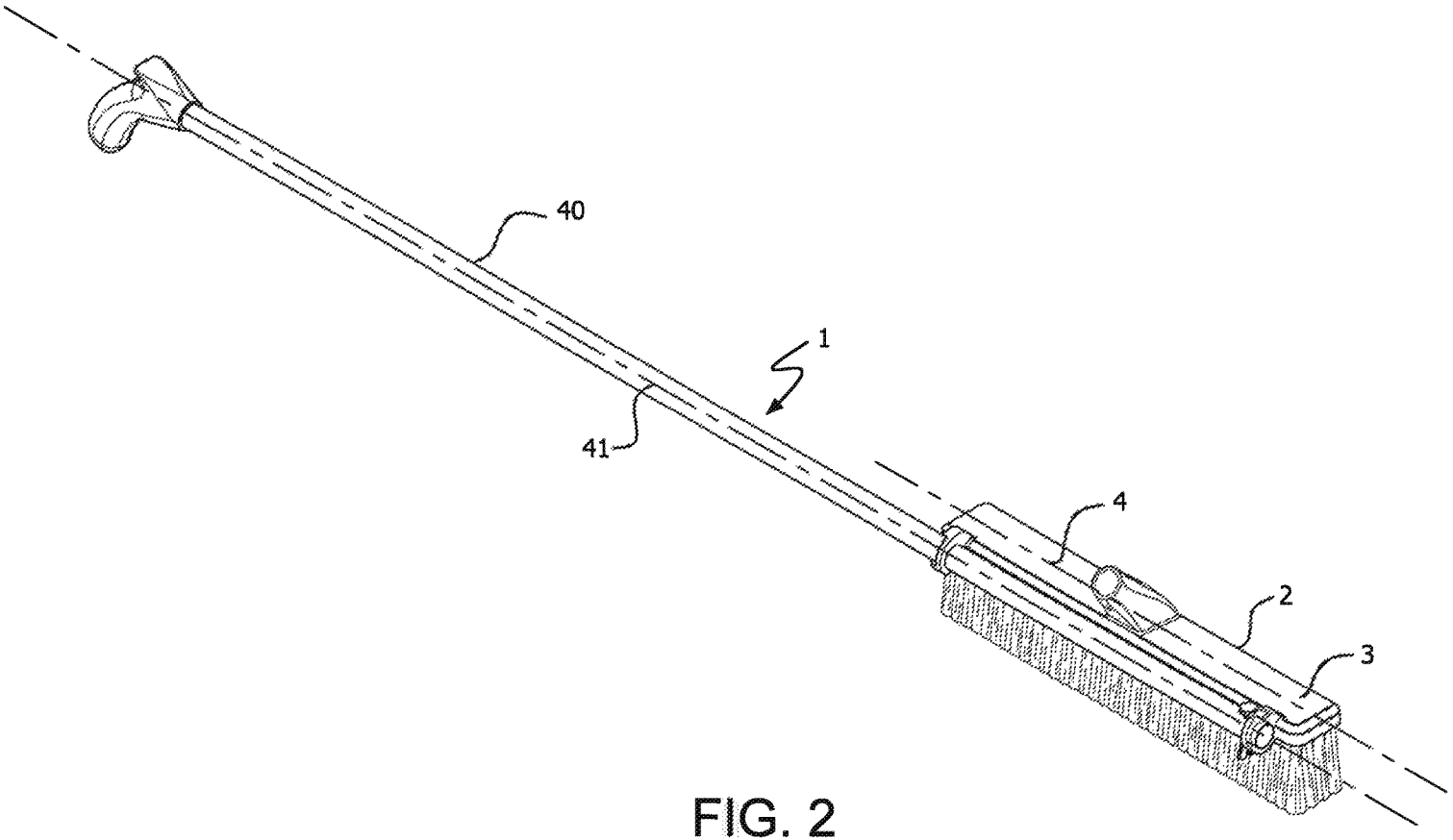
FIG. 2 is a perspective view of the push broom of the present invention in the shipping and merchandising mode.
Figure 3:
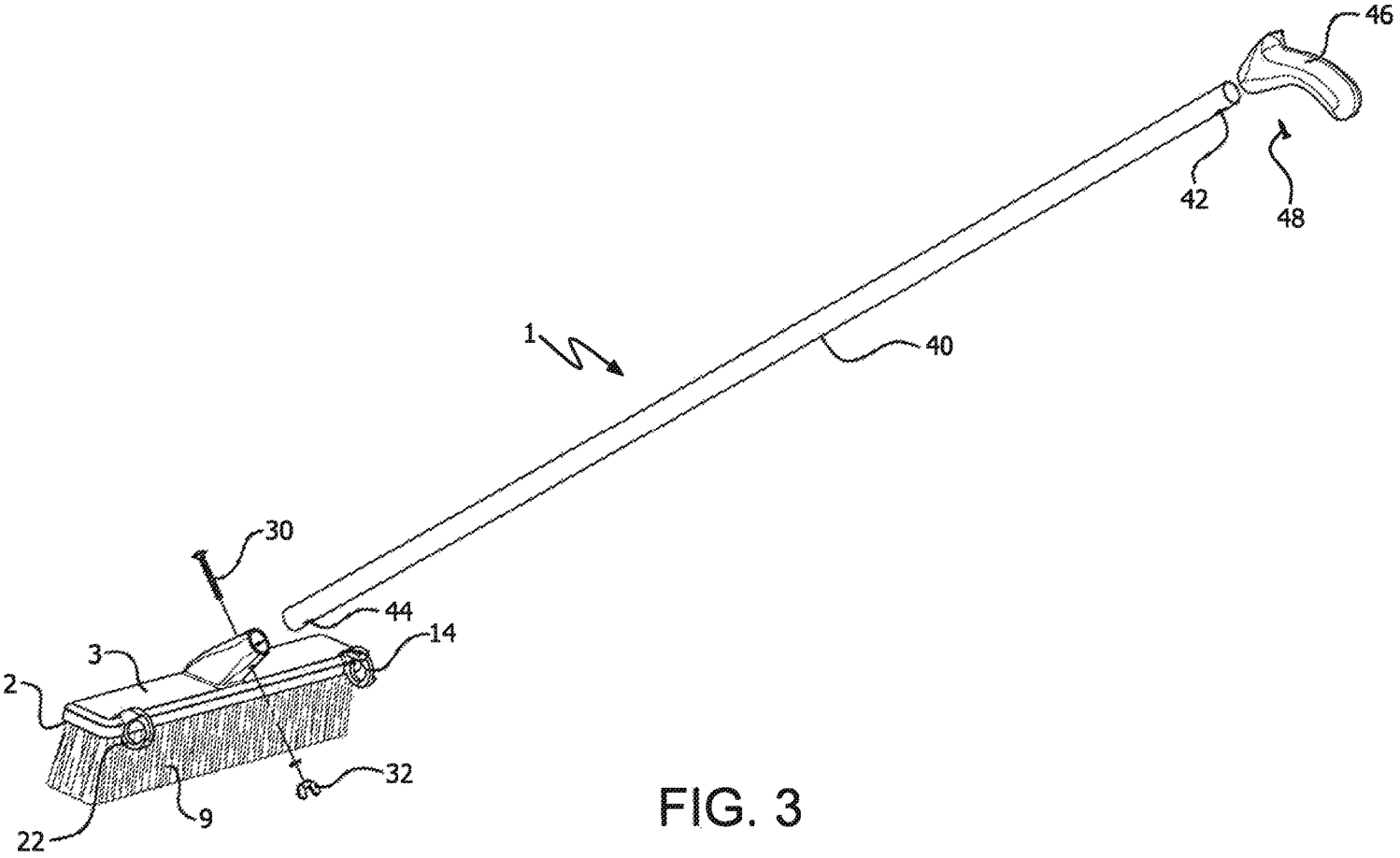
FIG. 3 is an exploded view of the components of the push broom of the present invention prior to its handle connection to the push broom head for the use mode.

In its shipping and merchandising mode, handle 40 is positioned within openings 16 and 24 of brackets 14 and 22, as shown in FIG. 2. Opening 44 of handle 40 is aligned with through channel 20 of tab 18, such that bolt 30 can be inserted through the opening and the through channel, to extend out of handle 40. Winged nut 32 is threadably screwed onto bolt 30 in order to secure handle 40 in the position shown in FIG. 2, with its longitudinal axis 41 parallel to longitudinal axis 4 of push broom block 3. Bolt 30 and winged nut 32 shown in the FIGS. comprise the handle connecting means for securing the handle to push broom block 3. However, other equivalent fastener members can be used. By means of this attachment, push broom head 2 and handle 40 are rigidly secured for shipment of the push broom, without the possibility that the push broom head and its handle will separate.

Figure 4:
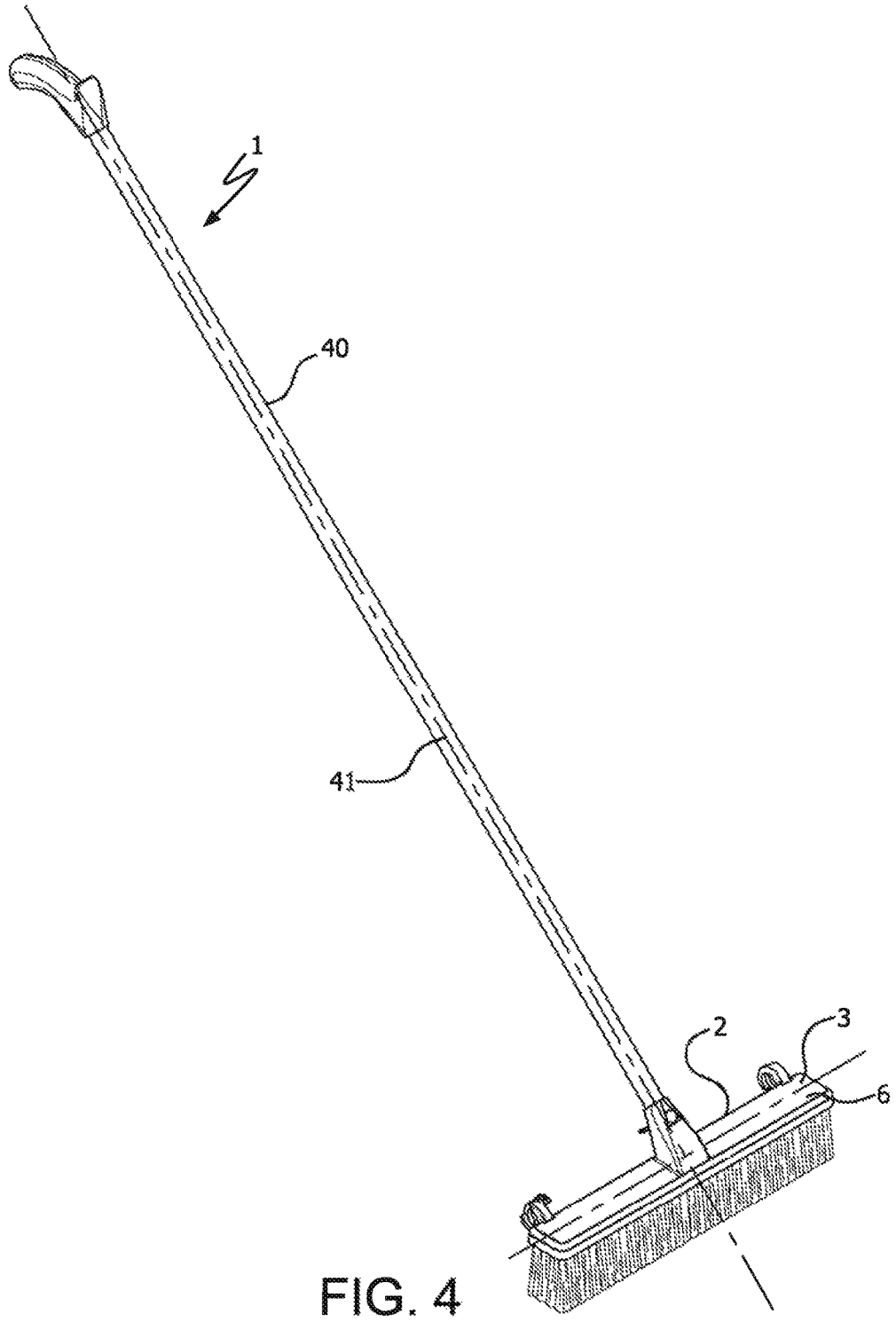
FIG. 4 is a perspective view of the push broom of the present invention in its fully connected use mode.

In order to go from the shipping mode shown in FIG. 2, to the use mode, shown in FIG. 4, wing nut 32 is simply unscrewed from bolt 30, which is then removed from through channel 20 and openings 42 and 44. Handle 40 is slid out from brackets 14 and 22 and is then inserted into opening 12 of handle receiving member 10, such that openings 11 and 13 of the handle receiving member are aligned with openings 42 and 44 of the handle. In this configuration, longitudinal axis 4 of block 3 is perpendicular to longitudinal axis 41 of handle 40. Bolt 30 is then inserted into openings 11, 42, 44, and 13 and then threadably attached by wing nut 32. This provides a secure connection between handle 40 and push broom block 3, permitting the use of the push broom without the prospect that the handle will be separated from the push broom block.

Figure 8:
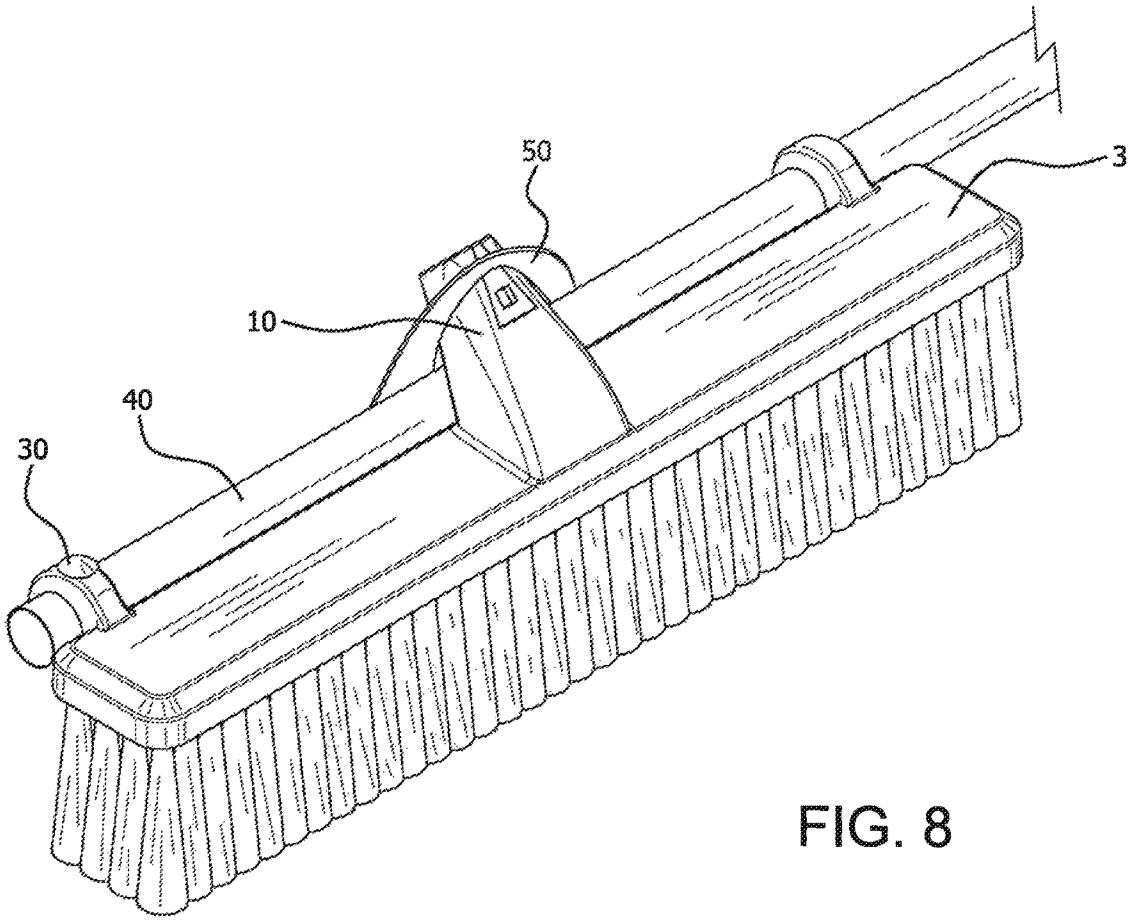
FIG. 8 is an isometric front view of an alternative embodiment of the push broom of the present invention in the shipping and merchandising mode.
Figure 9:
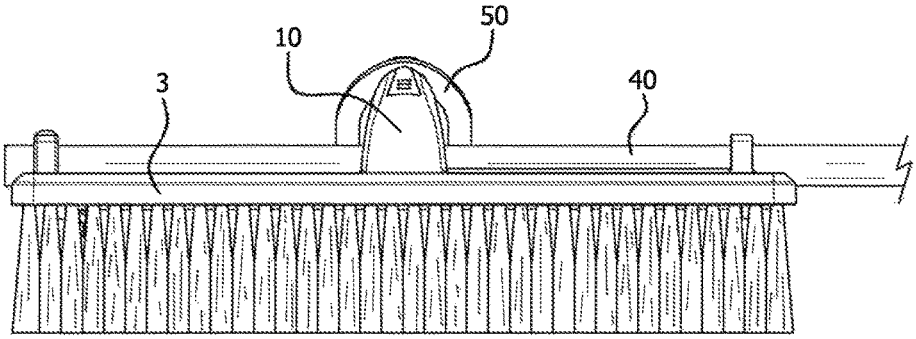
FIG. 9 is a front view of the embodiment shown in FIG. 8 in the shipping and merchandising mode.
Figure 10:
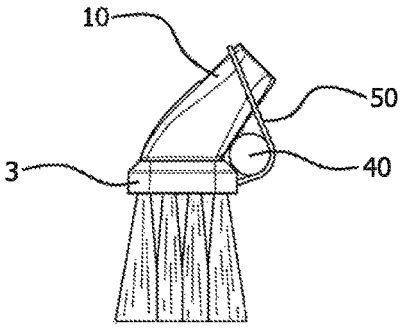
FIG. 10 is an elevation view of the embodiment shown in FIGS. 8 and 9 in the shipping and merchandising mode.

FIGS. 8-10 show an alternate embodiment of push broom head which has an additional unique feature. Integrally molded "U" shaped type support, e.g. strap 50, extends outward and upward from push broom block 3 and encircles the upper area of handle receiving member 10. By positioning handle 40 between the lower section of strap 50, push broom block 3, and handle receiving member 10, as best seen in FIG. 10, the handle is more securely supported and held in place when it is in the shipping and merchandising mode. Strap 50 also acts as a brace support for handle 40 when push broom 1 is in the use mode.

It is contemplated that push broom block 3 will be molded as a single integral body, the body including handle receiving member 10, brackets 14 and 22, 22*a*, or 14*b* and 22*b*, and, if utilized, strap 50. This will ensure that push broom block 3 can be efficiently and economically manufactured.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A push broom head for a push broom having a straight push broom handle with a longitudinal axis and an opening at an end portion thereof, the push broom head comprising:

an integral push broom block having a longitudinal axis, a top surface, a front surface, a rear surface, a handle receiving member extending up from the top surface, the handle receiving member having a first opening for receiving the end portion of the handle and a second opening transverse to the first opening, first and second brackets extending outwardly and rearwardly from the rear surface of the broom block on opposite sides of the handle receiving member, the first bracket adapted to receive and retain the end portion of the handle and the second bracket adapted to receive and retain an upper portion of the handle spaced from the end portion, the first bracket including a channel disposed transverse to a handle receiving opening thereof; and a handle fastening member for securing the handle in a first position within the first and second brackets and adjacent to the rear surface of the push broom block, and for securing the handle in a second position within the handle receiving member, whereby when the handle is secured in the first position the longitudinal axis of the handle is parallel to the longitudinal axis of the push broom block, and when the handle is secured in the second position the longitudinal axis of the handle is perpendicular to the longitudinal axis of the push broom block, the fastening member engaging the opening in the end portion of the handle through the second opening of the handle receiving member when in the second position and the fastening member engaging the opening in the end portion of the handle through the channel in the first bracket when in the first position.

2. The push broom head as in claim 1 wherein the first bracket is located at one end of the push broom block and the second bracket is located at the other end of the push broom block.

3. The push broom head as in claim 1 wherein the push broom block is a single molded body, said body including the handle receiving member and the first and second bracket.

4. The push broom head as in claim 1 wherein the first and second brackets are closed loops.

5. The push broom head as in claim 1 wherein the first and second brackets are open loops.

6. The push broom head as in claim 1 wherein the first and second brackets are curved, partial brackets.

7. The push broom head as in claim 1 further comprising a strap support extending outward from the push broom block for securely supporting the handle in said first position and for providing a bracing support for the handle in the second position.

8. The push broom head as in claim 7 wherein the strap support is a "U" shaped strap which encircles the handle receiving member.

9. A push broom comprising:

a straight push broom handle with a longitudinal axis and an opening at an end portion thereof; and a push broom head comprising:

an integral push broom block having a longitudinal axis, a top surface, a front surface, a rear surface, a handle receiving member extending up from the top surface, the handle receiving member having a first opening for receiving the end portion of the handle and a second opening transverse to the first opening, first and second brackets extending outwardly and rearwardly from the rear surface of the broom block on opposite sides of the handle receiving member, the first bracket adapted to receive and retain the end portion of the handle and the second bracket adapted to receive and retain an upper portion of the handle spaced from the end portion, the first bracket including a channel disposed transverse to a handle receiving opening thereof; and a handle fastening member for securing the handle in a first position within the first and second brackets and adjacent to the rear surface of the push broom block, and for securing the handle in a second position within the handle receiving member, whereby when the handle is secured in the first position the longitudinal axis of the handle is parallel to the longitudinal axis of the push broom block, and when the handle is secured in the second position the longitudinal axis of the handle is perpendicular to the longitudinal axis of the push broom block, the fastening member engaging the opening in the end portion of the handle through the second opening of the handle receiving member when in the second position and the fastening member engaging the opening in the end portion of the handle through the channel in the first bracket when in the first position.

10. The push broom as in claim 9 wherein the first bracket is located at one end of the push broom block and the second bracket is located at the other end of the push broom block.

11. The push broom head as in claim 9 wherein the push broom block is a single molded body, said body including the handle receiving member and the first and second bracket.

12. The push broom as in claim 9 wherein the first and second brackets are closed loops.

13. The push broom as in claim 9 wherein the first and second brackets are open loops.

14. The push broom as in claim 9 wherein the first and second brackets are curved, partial brackets.

15. The push broom head as in claim 9 further comprising a strap support extending outward from the push broom block for securely supporting the handle in said first position and for providing a bracing support for the handle in the second position.

16. The push broom head as in claim 15 wherein the strap support is a "U" shaped strap which encircles the handle receiving member.

* * * * *